US012663242B2

(12) United States Patent
Gish

(10) Patent No.: US 12,663,242 B2
(45) Date of Patent: Jun. 23, 2026

(54) WEAPON WITH INDICATOR ACTIVATED BASED ON POSITION

(71) Applicant: Axon Enterprise, Inc., Scottsdale, AZ (US)

(72) Inventor: Michael E. Gish, Scottsdale, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 48 days.

(21) Appl. No.: 18/694,809

(22) PCT Filed: Sep. 22, 2022

(86) PCT No.: PCT/US2022/044458

§ 371 (c)(1),
(2) Date: Mar. 22, 2024

(87) PCT Pub. No.: WO2023/172296

PCT Pub. Date: Sep. 14, 2023

(65) Prior Publication Data

US 2024/0410680 A1 Dec. 12, 2024

Related U.S. Application Data

(60) Provisional application No. 63/247,303, filed on Sep. 22, 2021.

(51) Int. Cl.
*F41H 13/00* (2006.01)

(52) U.S. Cl.
CPC ..... *F41H 13/0025* (2013.01)

(58) Field of Classification Search
CPC ..... F41H 13/0025; H05C 1/04
(Continued)

(56) References Cited

U.S. PATENT DOCUMENTS 7,631,452 B1 12/2009 Brundula et al.
10,809,040 B2 10/2020 Kim
(Continued)

FOREIGN PATENT DOCUMENTS

CN 101410689 A 4/2009
TW 201840952 A 11/2018
(Continued)

OTHER PUBLICATIONS

Machine translation of Angelidis et al. International Patent Document WO 2021/130348 A1 Jul. 2021 (Year: 2021).*
(Continued)

*Primary Examiner* — Kevin J Comber
(74) *Attorney, Agent, or Firm* — Andrew Graham

(57) ABSTRACT

An indication may be automatically provided based on a position of a weapon. The weapon may comprise a conducted electrical weapon ("CEW"). The indication may be provided from an indicator integrated with the weapon. The indication may comprise light emitted from a laser indicator integrated with the weapon. The indicator may be selectively activated in accordance with the position to provide the indication. The indication may be provided when the weapon is oriented in a direction in which a projectile may be deployed toward a remote location. The indication may be automatically provided when the weapon is disposed in a horizontal direction or a range of angles of the CEW. Methods, systems, and devices may selectively provide the indication in accordance with the position.

20 Claims, 3 Drawing Sheets

(58) Field of Classification Search
USPC ..... 361/232
See application file for complete search history.

(56) References Cited

U.S. PATENT DOCUMENTS

| | | | | |
|---|---|---|---|---|
| 2017/0025233 | A1* | 1/2017 | Prestwich | F16B 5/0258 |
| 2019/0257623 | A1* | 8/2019 | Nerheim | F41H 13/0025 |
| 2019/0376768 | A1 | 12/2019 | Nerheim | |
| 2020/0109918 | A1 | 4/2020 | York et al. | |
| 2020/0109926 | A1 | 4/2020 | Mata | |
| 2021/0148679 | A1 | 5/2021 | Basche et al. | |

FOREIGN PATENT DOCUMENTS

| | | | | |
|---|---|---|---|---|
| WO | 2019236114 | A1 | 12/2019 | |
| WO | 2021002922 | A2 | 1/2021 | |
| WO | WO-2021130348 | A1 * | 7/2021 | F41A 17/063 |
| WO | 2021178929 | A1 | 9/2021 | |
| WO | 2022261119 | A1 | 12/2022 | |

OTHER PUBLICATIONS

Taiwan Intellectual Property Office, Office Action for Taiwan Application No. 111135933 mailed Jun. 5, 2023.
Korean Intellectual Property Office, International Search Report for International Application No. PCT/ US22/44458, mailed Nov. 9, 2023.
European Patent Office, Extended European Search Report for European Patent Application No. 22931205.3, mailed Sep. 8, 2025.

* cited by examiner

WEAPON WITH INDICATOR ACTIVATED BASED ON POSITION

FIELD OF THE INVENTION

Embodiments of the present disclosure relate to a conducted electrical weapon. Specifically, the conducted electrical weapon may be configured to activate an indicator to provide an indication in accordance with a position of the conducted electrical weapon. The indication may comprise light emitted by a laser indicator integrated with the conducted electrical weapon.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Figure 1:
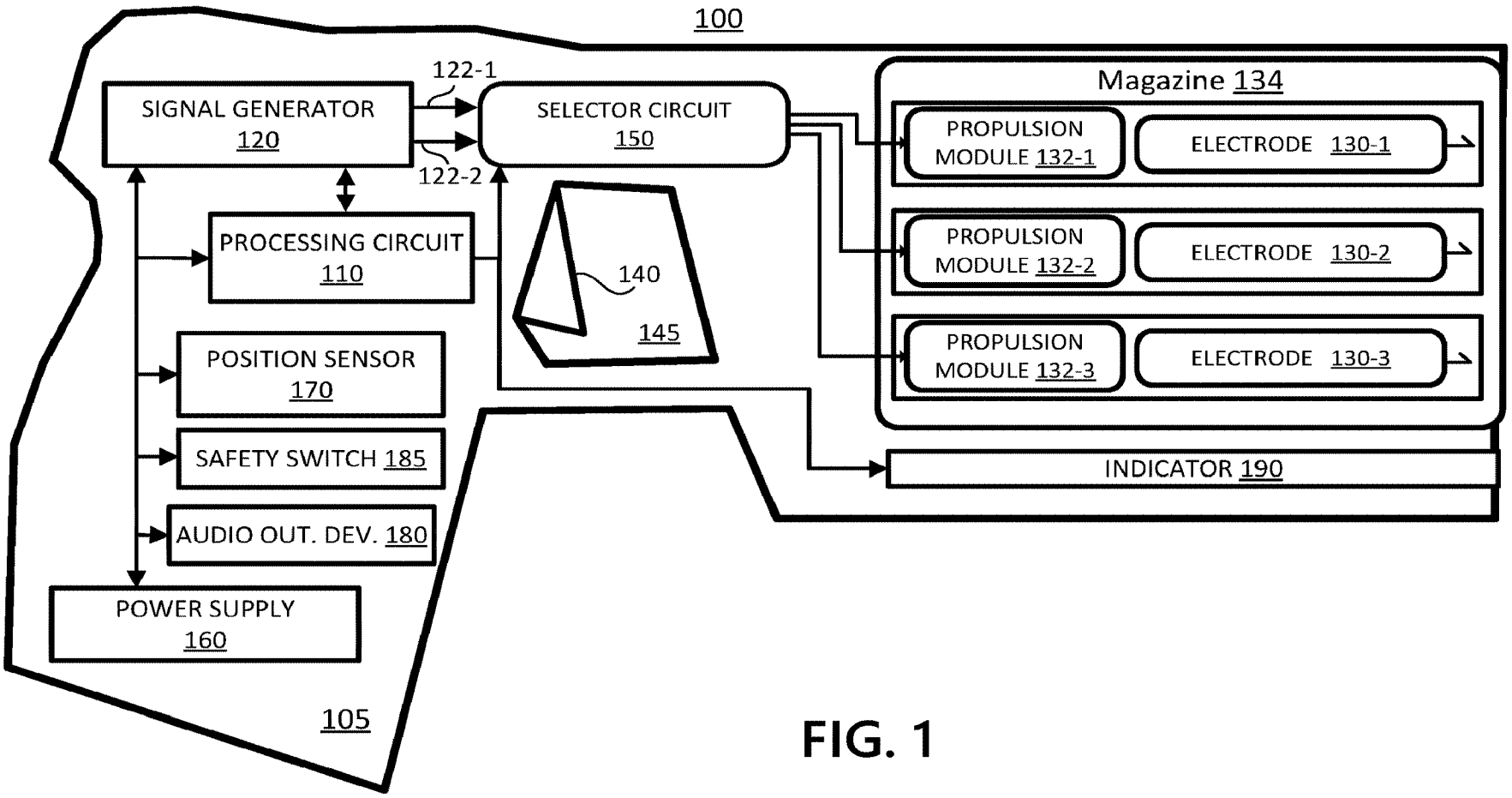
FIG. 1 illustrates a schematic diagram of a conducted electrical weapon, in accordance with various aspects of the disclosure.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected, or the like may include permanent, removable, temporary, partial, full, and/or any other possible attachment option. Additionally, any reference to without contact (or similar phrases) may also include reduced contact or minimal contact. Surface shading lines may be used throughout the figures to denote different parts but not necessarily to denote the same or different materials.

Systems, methods, and apparatuses may be used to interfere with voluntary locomotion (e.g., walking, running, moving, etc.) of a target. For example, a conducted electrical weapon may be used to deliver (e.g., conduct) an electrical current (e.g., stimulus signal, pulses of current, pulses of charge, etc.) through tissue of a human or animal target. Although referred to as a conducted electrical weapon, in the present disclosure, a conducted electrical weapon ("CEW") may refer to an electrical weapon, a conductive electrical weapon, an energy weapon, a conducted energy weapon, and/or any other similar device or apparatus configured to provide a stimulus signal through one or more deployed projectiles (e.g., electrodes).

A stimulus signal carries an electrical charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via two or more wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether).

Terminals or electrodes that contact or are proximate to the target's tissue deliver the stimulus signal through the target. Contact of a terminal or electrode with the target's tissue establishes an electrical coupling with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to the target's tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal (e.g., current, pulses of current, etc.) at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

A CEW may include at least two terminals at the face of the CEW. A CEW may include two terminals for each bay that accepts a deployment unit (e.g., cartridge). The terminals are spaced apart from each other. In response to the electrodes of the deployment unit in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because the terminals on a CEW are typically less than 6 inches apart, a stimulus signal delivered through the target's tissue via terminals likely will not cause NMI, only pain.

A series of pulses may include two or more pulses separated in time. Each pulse delivers an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and two or more deployment units. The handle may include one or more bays for receiving the deployment units. Each deployment unit may be removably positioned in (e.g., inserted into, coupled to, etc.) a bay. Each deployment unit may releasably electrically, electronically, and/or mechanically couple to a bay. A deployment of the CEW may launch one or more electrodes toward a target to remotely deliver the stimulus signal through the target.

In various embodiments, a deployment unit may include a single electrode. The deployment unit may deploy (e.g., launch) the single electrode individually. Launching the electrode may be referred to as activating (e.g., firing) a deployment unit. After use (e.g., activation, firing), a deployment unit may be removed from the bay and replaced with an unused (e.g., not fired, not activated) deployment unit to permit launch of additional electrodes.

Embodiments according to various aspects of the present disclosure comprise systems, methods, and devices for activating an indicator of a conducted electrical weapon that includes a position sensor. The conducted electrical weapon may include a plurality of deployable electrodes. The conducted electrical weapon may be configured to conduct an electrical stimulus signal through a target via the plurality of electrodes. The position sensor may detect a position of the conducted electrical weapon. For example, the position sensor may detect an orientation of the conducted electrical weapon. In accordance with the position, the conducted electrical weapon may selectively provide an indication from an indicator of the conducted electrical weapon.

For example, and with reference to FIG. 1, CEW 100 is disclosed. CEW 100 may be similar to, or have similar aspects and/or components with, any conducted electrical weapon discussed herein. CEW 100 may comprise a housing 105 and one or more deployment units 136 (e.g., cartridges). For example, CEW 100 may include a first deployment unit 136-1, a second deployment unit 136-2, and a third deployment unit 136-3. It should be understood by one skilled in the art that FIG. 1 is a schematic representation of CEW 100, and one or more of the components of CEW 100 may be located in any suitable position within, or external to, housing 105.

Housing 105 may be configured to house various components of CEW 100 that are configured to enable deployment of deployment units 136, provide an electrical current to the deployment units 136, and otherwise aid in the operation of CEW 100, as discussed further herein. Although depicted as a firearm in FIG. 1, housing 105 may comprise any suitable shape and/or size. Housing 105 may comprise a handle end 112 opposite a deployment end 114. Deployment end 114 may be configured, and sized and shaped, to receive one or more deployment units 136. Handle end 112 may be sized and shaped to be held in a hand of a user. For example, handle end 112 may be shaped as a handle to enable hand-operation of the CEW by the user. In various embodiments, handle end 112 may also comprise contours shaped to fit the hand of a user, for example, an ergonomic grip. Handle end 112 may include a surface coating, such as, for example, a non-slip surface, a grip pad, a rubber texture, and/or the like. As a further example, handle end 112 may be wrapped in leather, a colored print, and/or any other suitable material, as desired.

In various embodiments, housing 105 may comprise various mechanical, electronic, and/or electrical components configured to aid in performing the functions of CEW 100. For example, housing 105 may comprise one or more control interfaces 140, processing circuits 110, power supplies 160, and/or signal generators 120. Housing 105 may include a guard 145. Guard 145 may define an opening formed in housing 105. Guard 145 may be located on a center region of housing 105 (e.g., as depicted in FIG. 1), and/or in any other suitable location on housing 10. Control interface 140 may be disposed within guard 145. Guard 145 may be configured to protect control interface 140 from unintentional physical contact (e.g., an unintentional activation of a trigger). Guard 145 may surround control interface 140 within housing 105.

In various embodiments, control interface 140 may include a user control interface. A user control interface may be configured to be manually actuated by a user of CEW 100. A user control interface may include a trigger. A user control interface may be coupled to an outer surface of housing 105, and may be configured to move, slide, rotate, or otherwise become physically depressed or moved upon application of physical contact. For example, control interface 140 may be actuated by physical contact applied to control interface 140 from within guard 145. Control interface 140 may comprise a mechanical or electromechanical switch, button, trigger, or the like. For example, control interface 140 may comprise a switch, a pushbutton, and/or any other suitable type of trigger. Control interface 140 may be mechanically and/or electronically coupled to processing circuit 110. In response to control interface 140 being actuated (e.g., depressed, pushed, etc. by the user), processing circuit 110 may enable deployment of one or more deployment units 136 from CEW 100, as discussed further herein.

In some embodiments, CEW 100 additionally comprises a safety switch 185. Safety switch 185 may be coupled to an outer surface of housing 105, and may be configured to move, slide, rotate, or otherwise become physically depressed or moved upon application of physical contact. For example, safety switch may be activated by physical contact applied to safety switch 185 by a user of CEW 105, and may comprise any suitable mechanical or electromechanical switch, button, trigger, or the like. Safety switch 185 may be mechanically and/or electronically coupled to one or more control interface 140 or processing circuit 110. In some embodiments, safety switch 185 enables control interface 140 to be activated, e.g., such that a user of the CEW 100 may not activate control interface 140 prior to activating safety switch 185. In other embodiments, safety switch 185 enables deployment of a magazine and/or cartridge of CEW 100, such that safety switch 185 must be activated prior to control interface 140 successfully causing deployment of electrodes. In other embodiments, safety switch 185 may be a same component as control interface 140, such that a first activation actives safety switch 185 and a second activation activates trigger.

In various embodiments, housing 105 may comprise an indicator 190. Indicator 190 may comprise an output device configured to provide a human-perceivable indication from CEW 100. The indication may identify a mode of CEW 100. For example, indicator 190 may comprise a haptic, visual, or audible output device configured to indicate a safety OFF mode, safety ON mode, or other operating mode of CEW 100. Example output devices may comprise one or more of a light emitting diode, a display screen, a speaker that may comprise and/or be separate from audio output device 180, an eccentric rotating motor or servomotor. Alternately or additionally, the indication may identify an event type performed by the CEW. For example, indicator 190 may provide different indications for one or more of connections made by two or more electrodes of CEW 100, a de-escalation alert provided by CEW 100, a warning associated with an internal operation that may disable of CEW 100, and a notification associated with a status of CEW 100. Alternately or additionally, the indication may identify an alignment of the CEW. The alignment may comprise a position of CEW 100 relative to a reference position. The reference position may comprise one or more of a location of ground (e.g., floor, earth, etc.) of an environment in which CEW 100 is used, a location of a horizon of the environment in which CEW 100 is used, or a location of a target. The indicator may indicate the CEW 100 is aligned with the reference position. For example, the indicator may indicate CEW 100 is disposed in an orientation toward the reference position. Indicator 190 may be disposed in housing 105 parallel to an angle of deployment at which one or more electrodes 130 may be deployed from magazine 134 and/or handle 105. Indicator 190 may be configured to provide the indication parallel to the direction at which one or more projectiles (e.g., electrodes 130 or other projectiles deployable toward a remote location) may be deployed from the weapon (e.g., CEW 100 or other weapon). For example, indicator 190 may comprise a laser indicator (e.g., laser, aiming laser, targeting laser, aiming indicator, laser sight, etc.). An indication may comprise light emitted by the laser indicator. An indication generated by the laser indicator may comprise a laser beam (e.g., column of light). The laser beam may comprise a column of visible light emitted in a direction in which one or more electrodes 130 may be deployed from CEW 100. The indication may comprise a spot of light. The light spot may be disposed at a place where light emitted by indicator 190 reflects from a surface of an object. The laser indicator may visibly indicate a location at which one or more electrodes 130 may impact an object (e.g., target, environmental object, etc.) upon deployment of the one or more electrodes 130. Accordingly, indicator 190 may enable a user of CEW 100 to adjust a position of CEW 100. The user of CEW 100 may adjust an alignment of the CEW 100 relative to the object. For example, indicator 190 comprising a laser indicator may enable a user to modify an orientation of CEW 100 to enable an electrode (e.g., first electrode 130-1) to impact the target at a location on the target selected to cause NMI upon delivery of a stimulus signal via the electrode. Indicator 190 comprising the laser indicator may provide visual feedback of an alignment between an orientation of CEW 100 and the location on the target. Indicator 190 comprising the laser indicator may indicate whether the one or more electrodes 130 are oriented or not oriented toward the target prior to deployment of the one or more electrodes 130.

In embodiments, safety switch 185 may comprise a mode selection interface of the one or more control interfaces. Safety switch 185 may be disposed in a safety OFF or safety ON position. The safety OFF position may cause CEW 100 to be disposed in a safety OFF mode, while the safety ON position may cause CEW 100 to be disposed in safety ON mode. The safety OFF mode may enable control interface 140 and/or a cartridge to be activated and/or a corresponding function of such elements to be performed. The safety ON mode may cause control interface 140 and/or a cartridge to be deactivated and/or prevent a corresponding function of such elements to be performed. In some embodiments, the one or more control interfaces of CEW 100 (e.g., control interface 140, safety switch 185, other control interface, etc.) may cause CEW to be disposed in one or more other modes, including a mode associated with enabling a position-based activation of indicator 190 and another mode that disables the position-based activation of indicator 190. Modes associated with activating indicator 190 may comprise a testing, training, or safety OFF mode (e.g., armed). Modes associated with deactivating indicator 190 may comprise a calibration or safety ON mode (e.g., disarmed).

In various embodiments, power supply 160 may be configured to provide power to various components of CEW 100. For example, power supply 160 may provide energy for operating the electronic and/or electrical components (e.g., parts, subsystems, circuits, etc.) of CEW 100 and/or one or more deployment units 136. Power supply 160 may provide electrical power. Providing electrical power may include providing a current at a voltage. Power supply 160 may be electrically coupled to processing circuit 110 and/or signal generator 120. In various embodiments, in response to control interface 140 comprising electronic properties and/or components, power supply 160 may be electrically coupled to control interface 140. In various embodiments, in response to control interface 140 comprising electronic properties or components, power supply 160 may be electrically coupled to control interface 140. Power supply 160 may provide an electrical current at a voltage. Electrical power from power supply 160 may be provided as a direct current ("DC"). Electrical power from power supply 160 may be provided as an alternating current ("AC"). Power supply 160 may include a battery. The energy of power supply 160 may be renewable or exhaustible, and/or replaceable. For example, power supply 160 may comprise one or more rechargeable or disposable batteries. In various embodiments, the energy from power supply 160 may be converted from one form (e.g., electrical, magnetic, thermal) to another form to perform the functions of a system.

Power supply 160 may provide energy for performing the functions of CEW 100. For example, power supply 160 may provide the electrical current to signal generator 120 that is provided through a target to impede locomotion of the target (e.g., via deployment unit 20). Power supply 160 may provide the energy for a stimulus signal. Power supply 160 may provide the energy for other signals, including an ignition signal and/or an integration signal, as discussed further herein.

In various embodiments, processing circuit 110 may comprise any circuitry, electrical components, electronic components, software, and/or the like configured to perform various operations and functions discussed herein. For example, processing circuit 35 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 35 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 110 may include data buses, output ports, input ports, timers, memory, arithmetic units, and/or the like.

Processing circuit 110 may be configured to provide and/or receive electrical signals whether digital and/or analog in form. Processing circuit 110 may provide and/or receive digital information via a data bus using any protocol. Processing circuit 110 may receive information, manipulate the received information, and provide the manipulated information. Processing circuit 110 may store information and retrieve stored information. Information received, stored, and/or manipulated by processing circuit 110 may be used to perform a function, control a function, and/or to perform an operation or execute a stored program. For example, processing circuit 110 may receive position information from position sensor 170 and perform one or more operations based on the position information. Processing circuit 110 may comprise a clock (e.g., circuity configured to perform operations of a clock) and perform one or more operations based on a sequence of current times provided via the clock.

Processing circuit 110 may control the operation and/or function of other circuits and/or components of CEW 100. Processing circuit 110 may receive status information regarding the operation of other components, perform calculations with respect to the status information, and provide commands (e.g., instructions) to one or more other components. Processing circuit 110 may command another component to start operation, continue operation, alter operation, suspend operation, cease operation, or the like. Commands and/or status may be communicated between processing circuit 110 and other circuits and/or components via any type of bus (e.g., SPI bus) including any type of data/address bus.

In various embodiments, processing circuit 110 may be mechanically and/or electronically coupled to control interface 140. Processing circuit 110 may be configured to detect an activation, actuation, depression, input, etc. (collectively, an "activation event") at control interface 140. In response to detecting the actuation event, processing circuit 110 may be configured to perform various operations and/or functions, as discussed further herein. Processing circuit 110 may also include a sensor (e.g., a trigger sensor) attached to control interface 140 and configured to detect an activation event of control interface 140. The sensor may comprise any suitable mechanical and/or electronic sensor capable of detecting an activation event at control interface 140 and reporting the activation event to processing circuit 110.

In various embodiments, processing circuit 110 may be mechanically and/or electronically coupled to control interface 140 to receive an activation signal. The activation signal may include one or more of a mechanical and/or electrical signal. For example, the activation signal may include a mechanical signal received by control interface 140 and detected by processing circuit 110 as an activation event. Alternately or additionally, the activation signal may include an electrical signal received by processing circuit 110 from a sensor associated with control interface 140, wherein the sensor may detect an activation event of control interface 140 and provide the electrical signal to processing circuit 110. In embodiments, control interface 140 may generate an electrical signal in accordance with an activation event of control interface 140 and provide the electrical signal to processing circuit 110 as an activation signal.

In embodiments, processing circuit 110 may receive the activation signal from a different electrical circuit or device. For example, the activation signal may be received via a wireless communication circuit (not shown). The activation signal may be received from a different electrical circuit or device separate from processing circuit 110 and CEW 100. The activation signal may be received from a different electrical circuit or device external and in communication with processing circuit 110 and CEW 100. For example, the activation signal may be received from a remote-control device in wireless communication with CEW 100 and processing circuit 110 of CEW 100.

In various embodiments, control interface 140 may be repeatedly actuated to provide a plurality of activation signals. For example, a trigger may be depressed multiple times to provide a plurality of activation events of the trigger, wherein an activation signal is detected, received, or otherwise determined by processing circuit 110 each time the trigger is depressed. Each activation signal of the plurality of activation signals may be separately received by CEW 100 via control interface 140.

In various embodiments, control interface 140 may be actuated multiple times over a period of time to provide a sequence of activation signals. Each activation signal of the sequence may be received at a different, discrete time during the period of time. For example, a trigger of CEW 100 may be actuated at a first time during a period of time to provide a first activation signal and again actuated at a second time during the period of time to provide a second activation signal. A sequence of activation signals comprising the first activation signal and the second activation signal may be received by CEW 100 via the trigger during the period of time. CEW 100 may receive the sequence of activation signals via control interface 140 and perform at least one function in response to each activation signal of the sequence.

In embodiments, control interface 140 may be actuated for a duration of time to provide an activation signal for the duration of time. The activation signal may be provided to processing circuit 110 during the duration of time. For example, control interface 110 may be actuated (e.g., depressed) to initiate an activation at a first time and the control interface 110 may continue to be actuated during the duration of time until a second time. Processing circuit 110 may detect the activation signal at the first time in accordance with the actuation of control interface 110. Processing circuit 110 may also detect an end to the activation signal at the second time in accordance with the de-actuation (e.g., release) of control interface 110. During the duration of time, processing circuit 110 may continuously receive the activation signal from control interface 140. During the duration of time, processing circuit 110 may periodically detect the activation signal to confirm that the activation signal continues to be provided during the duration of time. During the duration of time, processing circuit 110 may continuously check a signal received via an electrical connection with control interface 140 to confirm that the signal is consistently received during the duration of time. At the second time, processing circuit 110 may detect the activation signal is no longer received via control interface 140. While the activation signal is received via control interface 140, CEW 100 may be configured to perform at least one function in accordance with receiving and continuing to receive the activation signal for the duration of time. When a first activation signal ends (e.g., is terminated, is no longer detected, is no longer received, etc.) the at one function may end as well. When a second activation signal is received after the first activation signal, another set of one or more operations may be performed in accordance with receiving the second activation for a second duration of time, different from the first activation signal and a first period of time during which the first activation signal was received. In alternate or additional embodiments, CEW 100 may be configured to automatically perform a plurality of operations, including deploying one or more next electrodes, independent of whether an activation signal continues to be received after CEW 100 deploys a first electrode responsive to initially receiving the activation signal.

In various embodiments, CEW 100 may comprise a position sensor (e.g., position detector) configured to detect a position associated with CEW 100. For example, CEW 100 may comprise position sensor 170. Position sensor 170 may be configured to detect a position of CEW 100. The position may be detected along an axis, within a plane, and/or in three-dimensional space. Position sensor 170 may include one or more sensors. The one or more sensors may each comprise various types of sensors to detect movement or other properties associated with CEW 100. For example, a sensor (e.g., detector) may include a radar-based sensor, infrared sensor, microwave sensor, gyroscope, ultrasonic detector, acoustic sensor, optical sensor, vibration detector, electromagnetic sensor, accelerometer, and/or an inertial measurement unit (IMU). In embodiments according to various aspects of the present disclosure, position sensor 170 may comprise at least one of a gyroscope or an inertial measurement unit.

In embodiments, a position of CEW 100 may comprise an orientation of CEW 100. The orientation may be detected (e.g., measured) via position sensor 170. The orientation may comprise a direction (e.g., direction of orientation) in which CEW 100 is oriented (e.g., aimed) at a point in time. The direction may correspond to a direction which one or more electrodes may be deployed from CEW 100. In embodiments, the direction may be determined in one or more planes. For example, the direction may be detected in a vertical plane, perpendicular to a ground plane. The direction may be detected in a single plane independent of rotation of the CEW within other planes. In some embodiments, the direction may be detected in multiple planes, enabling a three-dimensional orientation of CEW 100 to be determined.

In embodiments, a direction in which CEW 100 is oriented may be detected at different points in time. For example, CEW 100 may be directed in a first direction at a first time and oriented in a second direction at a second time. The first direction may define an angle of orientation relative to the second direction. A change in position of CEW 100 may comprise the angle of orientation of CEW 100 between the first direction and the second direction.

In embodiments, an angle of orientation may be measured within in at least one plane. For example, an orientation of CEW 100 may be measured in a vertical plane perpendicular to ground level (e.g., a ground plane). Alternately or additionally, the at least one plane may comprise a diagonal plane extending in a parallel or horizontal direction and a vertical or perpendicular direction relative to a ground level and/or a ground plane. In embodiments, the angle may be measured in a plane in which a maximum angle may be defined relative to the reference direction and a current direction in which a CEW (e.g., CEW 100) may be oriented. In embodiments, the angle may be measured in a single plane independent of any rotation of the CEW within another plane different from the single plane.

In embodiments, a position of CEW 100 may comprise a spatial location of CEW 100. The spatial location may be detected (e.g., measured) via position sensor 170. The spatial location may comprise a relative physical location at which CEW 100 is located at a point in time. In embodiments, the spatial location may be determined along one or more axes. For example, the spatial location may be detected along a vertical axis, perpendicular to a ground plane. The spatial location may comprise an elevation of CEW 100. In embodiments, the spatial location may be detected in multiple planes, enabling a three-dimensional spatial location of CEW 100 to be determined.

In embodiments, a spatial location of CEW 100 may be detected at different points in time. For example, CEW 100 may be physically positioned a first spatial location at a first time and physically positioned at a second spatial location at a second time. A difference between the first spatial location and the second spatial location may define a distance of movement of CEW 100. The distance may be defined in a direction between the first spatial location and the second spatial location. The direction may comprise a linear direction between the first spatial location and the second spatial location.

In embodiments, the distance may be measured along one or more axes. For example, the distance may be measured along a vertical axis in which CEW 100 may be moved between the first spatial location and the second spatial location. Three-dimensional movement of CEW 100 between a first spatial location and a second spatial location may comprise a vertical distance along a vertical axis, a horizontal distance along a horizontal axis between CEW 100 and a location of a target, and/or a lateral distance along a lateral axis perpendicular to the horizontal axis. The vertical axis may be defined perpendicular to one or more of ground and a location of a target relative to CEW 100.

In embodiments, position sensor 170 may detect a position of CEW 100 over time. For example, a first position may be detected at a first time and a second position may be detected at a second time. In embodiments, a time in which the position is detected may comprise a time before an electrode is deployed from CEW 100. In embodiments, a time in which the position is detected may comprise a time after an electrode was previously deployed from CEW 100.

In embodiments, a change in position of CEW 100 may be detected via position sensor 170. Position sensor 170 may detect a first position (e.g., first orientation and/or first spatial location, etc.) of CEW 100 at a first time and, at a second time, detect a second position (e.g., second orientation and/or second spatial location, etc.) of CEW 100. Processing circuit 110 may be configured to compare the first position and the second position to determine the change in position of CEW 100. The change in position may comprise a difference between the first position and the second position.

In some embodiments, detecting a position may comprise detecting an orientation of a CEW independent of a spatial position of the CEW. Detecting the position may comprise detecting the orientation of the CEW and not detecting the spatial position of the CEW An angle of orientation may be detected independent of a spatial position of the CEW at which the angle of orientation is detected, including any change in the spatial position of the CEW. In accordance with detecting the orientation independent of a spatial position, a rotational motion of the CEW may be detected over a period of time, separate from any translational motion of the CEW over the same period of time.

In various embodiments, CEW 100 may comprise an audio output device 180. Audio output interface 180 may comprise an audio transducer. In embodiments, audio output device 180 may include a loudspeaker or other type of audio transducer configured to output the one or more audible indicators.

In various embodiments, audio output interface 180 may comprise one or more output devices configured to provide one or more audible indicators regarding operation of CEW 100. For example, audio output interface 180 may be configured to provide one or more audio indicators (e.g., sounds) while an activation signal is received. The audio indicators may include a first audible indicator at one or more first times during reception of an activation signal and a second audible indicator at one or more second times during the reception of the activation signal, wherein the first audible indicator is different from the second audible indicator. For example, the first audible indicator may comprise a first tone of a first length and/or or first frequency and the second audible indicator may comprise a second tone of a second length and/second frequency, respectively different from the first length and the first frequency.

In various embodiments, processing circuit 110 may be electrically and/or electronically coupled to power supply 160. Processing circuit 110 may receive power from power supply 160. The power received from power supply 160 may be used by processing circuit 160 to receive signals, process signals, and transmit signals to various other components in CEW 100. Processing circuit 110 may use power from power supply 160 to detect an activation event of control interface 140 and generate one or more control signals in response to the detected activation event. The control signal may be based on the actuation. The control signal may be an electrical signal.

In various embodiments, processing circuit 110 may be electrically and/or electronically coupled to signal generator 120. Processing circuit 110 may be configured to transmit or provide control signals to signal generator 120 in response to detecting an actuation of a trigger of control interface 140. Processing circuit 110 may be configured to transmit or provide control signals to signal generator 120 in response to receiving an activation signal. Multiple control signals may be provided from processing circuit 110 to signal generator 120 in series. In response to receiving the control signal, signal generator 120 may be configured to perform various functions and/or operations, as discussed further herein.

In various embodiments, and with reference again to FIG. 1, signal generator 120 may be configured to receive one or more control signals from processing circuit 110. Signal generator 120 may provide an ignition signal to one or more deployment units 136 based on the control signals. Signal generator 120 may be electrically and/or electronically coupled to processing circuit 110 and/or deployment unit 136. Signal generator 120 may be electrically coupled to power supply 160. Signal generator 120 may use power received from power supply 160 to generate an ignition signal. For example, signal generator 120 may receive an electrical signal from power supply 160 that has first current and voltage values. Signal generator 120 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 120 may temporarily store power from power supply 160 and rely on the stored power entirely or in part to provide the ignition signal. Signal generator 120 may also rely on received power from power supply 160 entirely or in part to provide the ignition signal, without needing to temporarily store power.

Signal generator 120 may be controlled entirely or in part by processing circuit 110. In various embodiments, signal generator 120 and processing circuit 110 may be separate components (e.g., physically distinct and/or logically discrete). Signal generator 120 and processing circuit 110 may be a single component. For example, a control circuit within housing 105 may at least include signal generator 120 and processing circuit 110. The control circuit may also include other components and/or arrangements, including those that further integrate corresponding function of these elements into a single component or circuit, as well as those that further separate certain functions into separate components or circuits.

Signal generator 120 may be controlled by the control signals to generate an ignition signal having a predetermined current value or values. For example, signal generator 120 may include a current source. The control signal may be received by signal generator 120 to activate the current source at a current value of the current source. An additional control signal may be received to decrease a current of the current source. For example, signal generator 120 may include a pulse width modification circuit coupled between a current source and an output of the control circuit. A second control signal may be received by signal generator 120 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 120 may alternatively or additionally be employed, including those that apply a voltage over one or more different resistances to generate signals with different currents. In various embodiments, signal generator 120 may include a high-voltage module configured to deliver an electrical current having a high voltage. In various embodiments, signal generator 120 may include a low-voltage module configured to deliver an electrical current having a lower voltage, such as, for example, 2,000 volts.

Responsive to receipt of a signal indicating actuation of control interface 140 (e.g., an activation event), a control circuit provides an ignition signal to one or more deployment units 136. For example, signal generator 120 may provide an electrical signal as an ignition signal to first deployment unit 136-1 in response to receiving a control signal from processing circuit 110. In various embodiments, the ignition signal may be separate and distinct from a stimulus signal. For example, a stimulus signal in CEW 100 may be provided to a different circuit within first deployment unit 136-1, relative to a circuit to which an ignition signal is provided. Signal generator 120 may be configured to generate a stimulus signal. In various embodiments, a second, separate signal generator, component, or circuit (not shown) within housing 105 may be configured to generate the stimulus signal. Signal generator 120 may also provide a ground signal path for deployment units 136, thereby completing a circuit for an ignition signal provided to deployment units 136 by signal generator 120. The ground signal path may also be provided to deployment unit 20 by other elements in housing 105, including power supply 160.

Signal generator 120 may generate at least two output signals 122. The at least two output signals 122 may include at least two different voltages, wherein each different voltage of the at least two different voltages is determined relative to a common reference voltage. The at least two signals may include first output signal 122-1 and second output signal 122-2. The first output signal 122-1 may have a first voltage. The second output signal 122-2 may have a second voltage. The first voltage may be different from the second voltage relative to a common reference voltage (e.g., ground, the first voltage, the second voltage, etc.). Selector circuit 150 may couple the first output signal 122-1 and the second output signal 122-2 to deployment units 136. Selector circuit 150 may be configured to selectively couple output signals 122 to deployment units 136 in accordance with one or more control signals received by selector circuit 150 from processing circuit 110. For example, selector circuit 150 may comprise one or more switches that, in response to one or more controls from processing circuit 110, selectively couple one or more output signals 122 to one or more respective deployment units 136. The at least two output signals 122 may be coupled to separate, respective electrical signal paths within CEW 100. The at least two output signals 122 may be provided to a remote location via separate, respective electrical signal paths between CEW 100 and the remote location. Coupling of the at least two electrical signals 122 through a load at the remote location may enable an electrical signal to be delivered at the remote location, wherein the electrical signal comprises a current determined in accordance with at least two different voltages of the at least two output signals 122 and a resistance of the load. For example, a stimulus signal may be provided at a remote location in accordance with a first voltage of first output signal 122-1, a second voltage of second output signal 122-1, and a load at the remote location, wherein an amount of current of the stimulus signal is determined in accordance with a resistance of the load and a voltage difference between the first voltage and the second voltage.

In various embodiments, deployment units 136 may comprise propulsion modules 132 and projectiles. The projectiles may include electrodes 130. Each deployment unit of deployment units 136 may comprise a separate propulsion module and projectile. For example, first deployment unit 136-1 comprises electrode 130-1 and propulsion module 132-1, second deployment unit 136-2 comprises second electrode 130-2 and propulsion module 132-2, and third deployment unit 136-3 comprises third electrode 130-3 and propulsion module 132-3.

In various embodiments, each electrode of electrodes 130 may be configured to provide a single conductive signal path between CEW 100 and a remote location upon deployment. For example, each electrode of the electrodes 130 may comprise a single electrical conductor. Further, each electrode of the electrodes 130 may be coupled to CEW 100 via a respective filament. Each filament may further comprise a single conductor. Accordingly, in various embodiments, each electrode of electrodes 130 may be selectively coupled to one of first output signal 122-1 and second output signal 122-2 at a time. For example, at a given time, first electrode 130-1 may be coupled to either first output signal 122-1 and second output signal 122-2; second electrode 130-2 may be coupled to either first output signal 122-1 and second output signal 122-2; and third electrode 130-3 may be coupled to either first output signal 122-1 or second output signal 122-2. In various embodiments, each such electrode of electrodes 130 may either be coupled to a first voltage of first output signal 122-1 or a second voltage of second output signal 122-2 at the given time. As noted above, remote delivery of a current, including a current of a stimulus signal, is determined in accordance with two different voltages provided at a remote location according to various aspects of the present disclosure.

Magazine 134 may be releasably engaged with housing 105. Magazine 134 may include a plurality of firing tubes, where each firing tube is configured to secure one deployment unit of deployment units 136. Magazine 134 may be configured to launch electrodes 130 housed in deployment units 136 installed in each of the plurality of firing tubes of magazine 134. Magazine 134 may be configured to receive any suitable or desired number of deployment units 136, such as, for example, one deployment unit, two deployment units, three deployment units, six deployment units, nine deployment units, ten deployment units, etc.

In various embodiments, propulsion modules 132 may be coupled to, or in communication with respective projectiles in deployment units 136. Propulsion modules 132 may comprise any device, such as propellant (e.g., air, gas, etc.), primer, or the like capable of providing propulsion forces in deployment units 136. The propulsion force may include an increase in pressure caused by rapidly expanding gas within an area or chamber. A propulsion force from each of propulsion modules 132 may be applied to respective projectiles 130 in deployment units 136 to cause the deployment of electrodes 130. Propulsion modules 132 may provide the respective propulsion forces in response to deployment units 136 receiving one or more ignition signals.

In various embodiments, a propulsion force may be directly applied to a projectile. For example, a first propulsion force may be provided directly to first electrode 130-1 via propulsion module 132-1. Propulsion module 132-1 may be in fluid communication with electrode 130-1 to provide the propulsion force. For example, the propulsion force from propulsion module 132-1 may travel within a housing or channel of deployment unit 136-1 to electrode 130-1.

In various embodiments, each projectile of deployment units 136 may comprise any suitable type of projectile. For example, the projectiles may be or include electrodes 130 (e.g., electrode darts). Each electrode of electrodes 130 may include a spear portion, designed to pierce or attach proximate a tissue of a target in order to provide a conductive electrical path between the electrode and tissue. For example, first deployment unit 136-1 may include first electrode 130-1, second deployment unit 136-1 may include second electrode 130-2, and third deployment unit 136-3 may include third electrode 130-3. Electrodes 130 may be deployed from deployment units 136 in series over time. In embodiments, a single electrode (e.g., first electrode 130-1 or second electrode 130-2) launched in response to an ignition signal as further discussed herein.

As understood by a person of ordinary skill in the art, a computer-readable medium comprising computer-executable instructions that are configured to be executed by a processor (e.g., processing circuit 110 comprising a processor and non-volatile memory storing the instructions, with brief reference to FIG. 1) may perform one or more processes disclosed herein.

Figure 2:
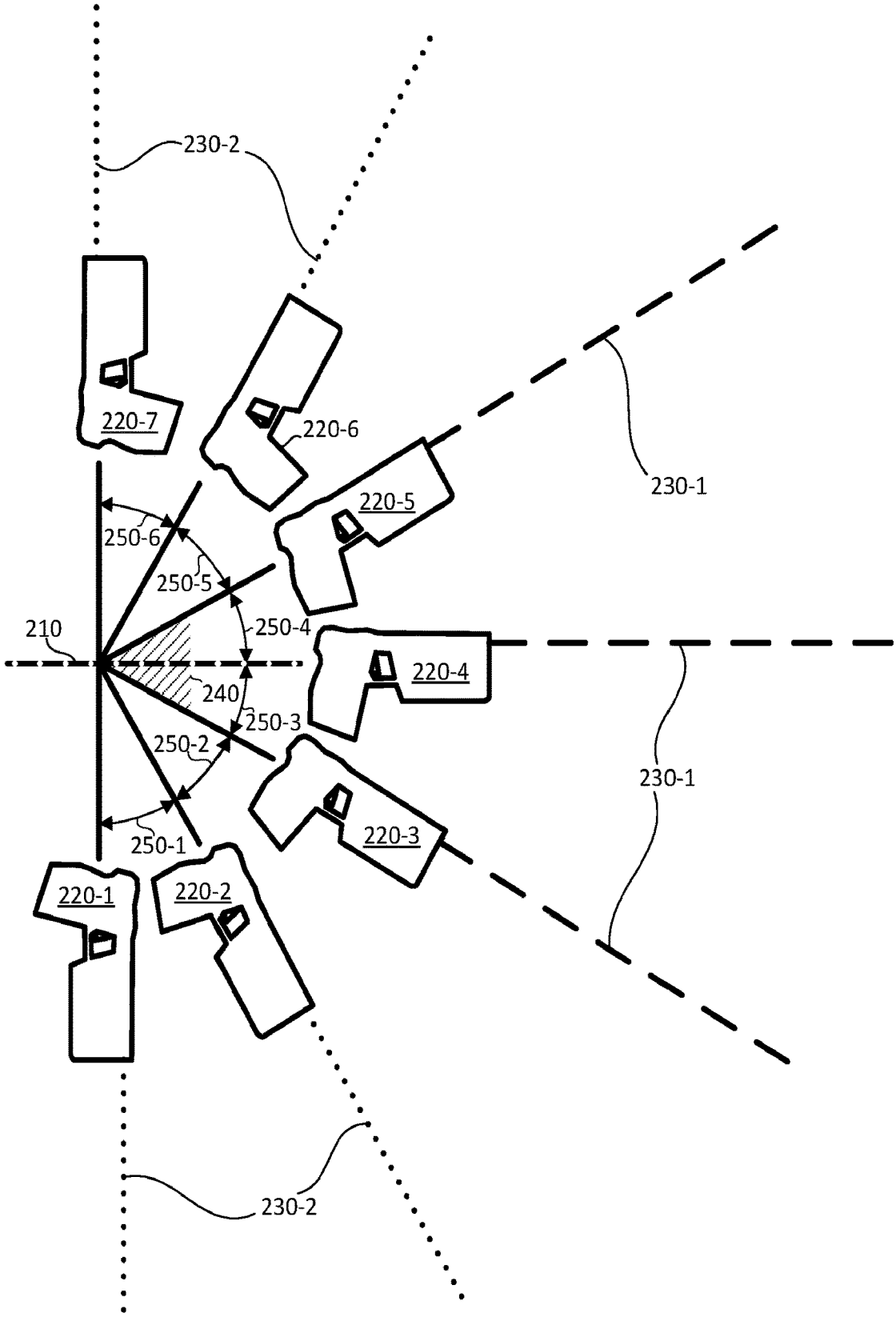
FIG. 2 illustrates a conducted electrical weapon configured to automatically activate an indicator relative to a position of the conducted electrical weapon according to various aspects of the disclosure.

In various embodiments, a CEW may be configured to selectively activate an indicator in accordance with a position of the CEW. An indication may be selectively provided by the indicator in accordance with control of the indicator by the CEW. By selectively activating the indicator, power of the CEW may be preserved by not activating the indicator when the CEW is not disposed in a position (e.g., predetermined position, reference position, threshold position, range of positions, etc.) to deploy an electrode or perform another operation of the CEW. Selective activation of the indicator may also avoid the indicator from providing an indication in a direction that may cause injury or distraction during an event. Selective activation of the indicator during use of the CEW may also enable the indicator to indicate an escalation of a use of force via the CEW. The selectively activated indicator may provide an additional warning that one or more electrodes may be subsequently deployed from the CEW. A use of force associated with activation of the indicator (e.g., a change from a deactivated state to an activated state) may also be logged by the CEW to enable subsequent review of use of the CEW during an event. FIG. 2 illustrates a CEW configured to automatically activate an indicator relative to a position of the conducted electrical weapon according to various aspects of the disclosure. The CEW of FIG. 2 may comprise and/or correspond to CEW 100 with brief reference to FIG. 1.

In embodiments, CEW according to various aspects of the present disclosure may be disposed in one or more positions 220. A same CEW (e.g., CEW 100) may be disposed in each of the one or more positions 220. The one or more positions 220 may comprise a first position 220-1, a second position 220-2, a third position 220-3, a fourth position 220-4, a fifth position 220-5, a sixth position 220-6, or a seventh position 220-7. Positions 220 may comprise different pitches at which the CEW may be disposed. Positions 220 may comprise angular positions at which the CEW may be disposed. Positions 220 may comprise different orientations at which the CEW may be manually provided by a user of the CEW. Positions 220 may comprise different rotations of the CEW about a horizontal axis 210 or other common reference axis. Each position of positions 220 may comprise a respective angle of orientation defined between an orientation of the CEW and the horizontal axis 210 or other common reference axis. Each position of positions 220 may correspond to an angle at which a projectile may be concurrently deployed from the weapon. Horizonal axis 210 may be disposed perpendicular to a plane of illustration of FIG. 2. Horizonal axis 210 may comprise and/or be disposed parallel to a horizonal axis of the CEW. The first direction 220-1 may be disposed in a downward direction (e.g., direction of a pull of gravity on CEW, direction toward a reference location of ground below CEW, downward vertical direction, etc.). The seventh direction 220-7 may be disposed in an upward direction opposite the downward direction (e.g., opposite direction of a direction of a pull of gravity on CEW, direction away from a reference location of ground below CEW, upward vertical direction, etc.). The first direction 220-1 and seventh direction 220-1 may be disposed along a common vertical axis. The fourth position 220-4 may comprise a horizontal position of the CEW. The fourth position 220-4 may be perpendicular one or more of first position 220-1 and seventh position 220-7. The fourth position 220-4 may comprise an angle of orientation of zero degrees. The fourth position 220-4 may be parallel with a horizontal axis of the CEW and/or be disposed in a reference direction of the CEW. The first position 220-1 may comprise an angle of orientation of zero degrees. At the first position 220-1, the CEW may be arranged to deploy one or more electrodes in a horizontal direction. The seventh position 220-7 may comprise an angle of orientation of positive ninety degrees. The first position 220-1 may comprise an angle of orientation of negative ninety degrees. An angle of orientation of the CEW may increase from the first position 220-1 to the seventh position 220-7. For example, an angle of orientation of third position 220-3 may be greater than an angle of orientation of second position 220-2. An angle of orientation of third position 220-3 may be less than an angle of orientation of fifth position 220-5. The one or more positions 220 of FIG. 2 are representative positions provided for purposes of illustration. A CEW according to various aspects of the present disclosure may be disposed in additional or fewer positions relative to those illustrated in FIG. 2. A CEW according to various aspect of the present disclosure may be disposed in a range of positions between an upward direction and a downward direction about a horizontal axis about which the CEW may be oriented. A same CEW may be rotated through each rotational position between first position 220-1 and seventh position 220-7 in embodiments according to various aspects of the present disclosure.

In embodiments, two or more of the positions 220 may comprise different vertical positions and/or horizontal positions. For example, third position 220-3 may be disposed at a same or different height and/or lateral position relative to second position 220-2. The different positions may be caused by a manual positioning of the CEW or movement of a user holding the CEW. In embodiments, an indicator of a CEW may be selectively activated in accordance with a rotation about a single axis (e.g., lateral, horizontal. or pitch axis) of the CEW, independent of rotation of the CEW about other axes of the CEW.

In embodiments, the CEW may be configured to selectively activate an indicator of the CEW. An indication provided by the indicator may be adjusted in accordance with the indicator being selectively activated. The indicator may be selectively provided in one of a plurality of activation states 230. For example, the activation state 230 may comprise one of an active state 230-1 (e.g., activated state) and an inactive state 230-2 (e.g., deactivated state). The activation states may be exclusive states, such that the indicator may be disposed in only one activation state in embodiments according to various aspects of the present disclosure. In embodiments, the indicator may be selectively controlled or caused to enter an activation state of the plurality of activation states 230 in accordance with other operations performed by the CEW in which the indicator is integrated.

In an active state 230-1, an indication may be provided from the CEW. The indication may comprise a visible indication. For example, a laser indicator may emit a laser beam from the CEW in the active state. In the active state 230-1, the indicator may be enabled (e.g., powered, turned on, receive an enabling control signal, etc.) to cause the indicator to output the indication. Active state 230-1 may enable alignment of the CEW with an object to be visually identified. In other embodiments, the indication may alternately or additionally comprise an audible indication provided by an audio output device.

In an inactive state 230-2, an indication may not be provided from the CEW. The inactive state 230-2 may lack an indication providable by an indicator of the CEW. An indicator may discontinue or otherwise not provide the indication that is provided in an active state 230-1. For example, a laser indicator may be turned off, prevented from emitting, or otherwise not emit a laser beam from the CEW in the inactive state 230-2. A visible indication may not be generated from the CEW in an inactive state 230-2. In the inactive state 230-2, the indicator may be disabled (e.g., unpowered, turned off, receive a disabling control signal, etc.) to cause the indication to not be output from the CEW. Relative to the active state 230-1, inactive state 230-2 may save electrical power otherwise expended by providing an indication from an indicator in an active state 230-1.

In embodiments, the CEW may be configured to selectively activate an indicator in accordance with the position of the CEW. The position may comprise a position of one or more positions 220. The position may comprise an angle of orientation of the CEW. In embodiments, positions 220 may comprise one or more activation positions in which an indicator is activated and one or more deactivation positions in which the indicator is deactivated. At each of the positions, the CEW may be configured to detect the position and responsive to the detected position, activate or deactivate an indicator of the CEW. For example, processing circuit 110 of CEW 100 may be configured to detect a position via position detector 170 and, responsive to the position, enable indicator 190.

In embodiments. the indicator may be activated when the CEW is disposed in one more activation positions. For example, the indicator of the CEW may be activated in activation positions comprising third position 220-3, fourth position 220-4, fifth position 220-5, a position between third position 220-3 and fourth position 220-4, and/or a position between fourth position 220-4 and fifth position 220-5. At each of the activation positions, an indicator of the CEW may be disposed in active state 230-1. An indictor comprising a laser indicator may generate a laser beam in accordance with the CEW being detected to be disposed in an activation position and the indicator being provided in active state 230-1. The laser indicator may begin or continue emitting the laser beam upon detection of the CEW being disposed in an activation position. The CEW may be configured to detect the position and responsive to the detected position comprising an activation position, dispose the indicator in active state 230-1 to cause the visual indicator to be generated by the CEW.

In embodiments. the indicator may be deactivated when the CEW is disposed in one more deactivation positions. For example, the indicator of the CEW may be deactivated in deactivation positions comprising first position 220-1, second position 220-2, sixth position 220-6, seventh position 220-7, a position between first position 220-1 and third position 220-3, and/or a position between fifth position 220-5 and seventh position 220-7. At each of the deactivation positions, an indicator of the CEW may be disposed in inactive state 230-2. An indictor comprising a laser indicator may disable (e.g., not emit, not generate, etc.) a laser beam in accordance with the CEW being detected to be disposed in a deactivation position and the indicator being provided in inactive state 230-2. The laser indicator may stop or continue preventing emission of the laser beam upon detection of the CEW being disposed in a deactivation position. The CEW may be configured to detect the position and responsive to the detected position comprising a deactivation position, dispose the indicator in inactive state 230-2 to cause the visual indicator to not be generated by the CEW.

In embodiments, one or more positions at which the indicator of the CEW may be activated (e.g., activation positions) may comprise at least one range of positions. A range of the at least one range of positions may be defined between a first angle of orientation of the CEW and a second angle of orientation of the CEW. For example, the indicator of the CEW may be activated at range of positions 240.

In embodiments, a range of positions may comprise a maximum angle of orientation at which an indicator may remain in active state 230-1 The maximum angle may comprise a first position by which the range is defined. The maximum angle may comprise an orientation of a position at which the CEW may be disposed within the range. For example, a maximum angle for range 240 may comprise fifth position 220-5. Fifth position 220-5 may comprise a maximum position at which range 240 is defined. In embodiments, fifth position 220-5 may comprise an angle of orientation between positive fifteen and positive forty-five degrees. For example, fifth position 220-5 may comprise an angle of orientation of positive thirty degrees. At a position greater than the maximum angle, an indicator may be disposed in inactive state 230-2. At a position equal to or less than the maximum angle, the same indicator may be provided in active state 230-1.

In embodiments, a range may comprise a minimum angle or orientation at which an indicator may remain in active state 230-1 The minimum angle may comprise a second position by which the range is defined. For example, a minimum angle for range 240 may comprise third position 220-3. Third position 220-3 may comprise a minimum position at which range 240 is defined. Third position 220-3 may comprise an angle of orientation between negative fifteen and negative forty-five degrees. For example, third position 220-3 may comprise an angle of negative thirty degrees. At a position less than the minimum angle, an indicator may be disposed in inactive state 230-2. At a position equal to or greater than the minimum angle, the same indicator may be provided in active state 230-1.

In embodiments, a minimum angle may be determined in accordance with a direction of rotation of a CEW. The minimum angle may differ in accordance with different directions of rotation of the CEW. The different directions may comprise opposite directions. For example, when the CEW is rotated in an upward direction, such as in a rotational direction from first position 220-1 toward seventh position 220-7 with brief reference to FIG. 2, the minimum angle may comprise a first angle of orientation. When the CEW is rotated in a downward direction, such as in a rotational direction from seventh position 220-7 toward first position 220-1 with brief reference to FIG. 2, the minimum angle may comprise a second angle of orientation different from the first angle of orientation. In some embodiments, the first angle of orientation may be greater than the second angle of orientation. For example, the first angle of orientation may comprise negative thirty degrees and the second angle of orientation may comprise negative thirty-five degrees. In accordance with the different angles of orientation and determining the minimum angle in accordance with the direction of rotation, an indicator may be biased to remain in an active state once the CEW has been disposed in an active position. Such an arrangement may also avoid unintended activation of a deactivated indicator for positions of the CEW between the first minimum angle and the second minimum angle.

In embodiments, range 240 may comprise a horizontal orientation of the CEW. For example, a central angle of orientation of range 240 may comprise fourth position 240-4. Fourth position 240-4 may comprise a horizontal position of the CEW. Range 240 may comprise a set of angles 250 above and below the central angle. For example, range 240 may comprise fourth set of angles 250-4 greater than fourth position 220-4 and third set of angles 250-3 less than fourth position 240-4. Range 240 may comprise an angle equal to or less than ninety degrees, equal to or less than seventy-five degrees, equal to or less than sixty degrees, or equal to or less than forty-five degrees. For example, a total angle between a maximum angle of range 240 and a minimum angle of range 240 may be equal or less than seventy-five degrees. In some embodiments, an angle of range 240 may span between a positive angle of orientation of a maximum position of range 240 and a negative angle of orientation of a minimum position of range 240. For example, and provide such a total angle for range 240, the maximum angle may comprise a positive forty-degree angle of orientation and the minimum angle may comprise a negative thirty-five degree angle of orientation. The angle of range 240, including the maximum and minimum angles of orientation by which the angle may be defined, may be predetermined. Such a predetermined angle may enable an indicator to be selectively activated in a predictable manner upon use of the CEW. In each angle of orientation with range 240 and corresponding position of positions 220, the CEW may be oriented to deploy one or more electrodes toward an object located at a range of distances from the CEW. At positions of positions 220 associated with range 240, an object may be disposed at a distance from the CEW at which a visible indication provided by the indicator of the CEW may visually indicate the CEW is aligned with the object to contact the object with a deployed electrode. In embodiments, a CEW may be configured to detect additional ranges of activation positions, in addition to range 240.

Figure 3:
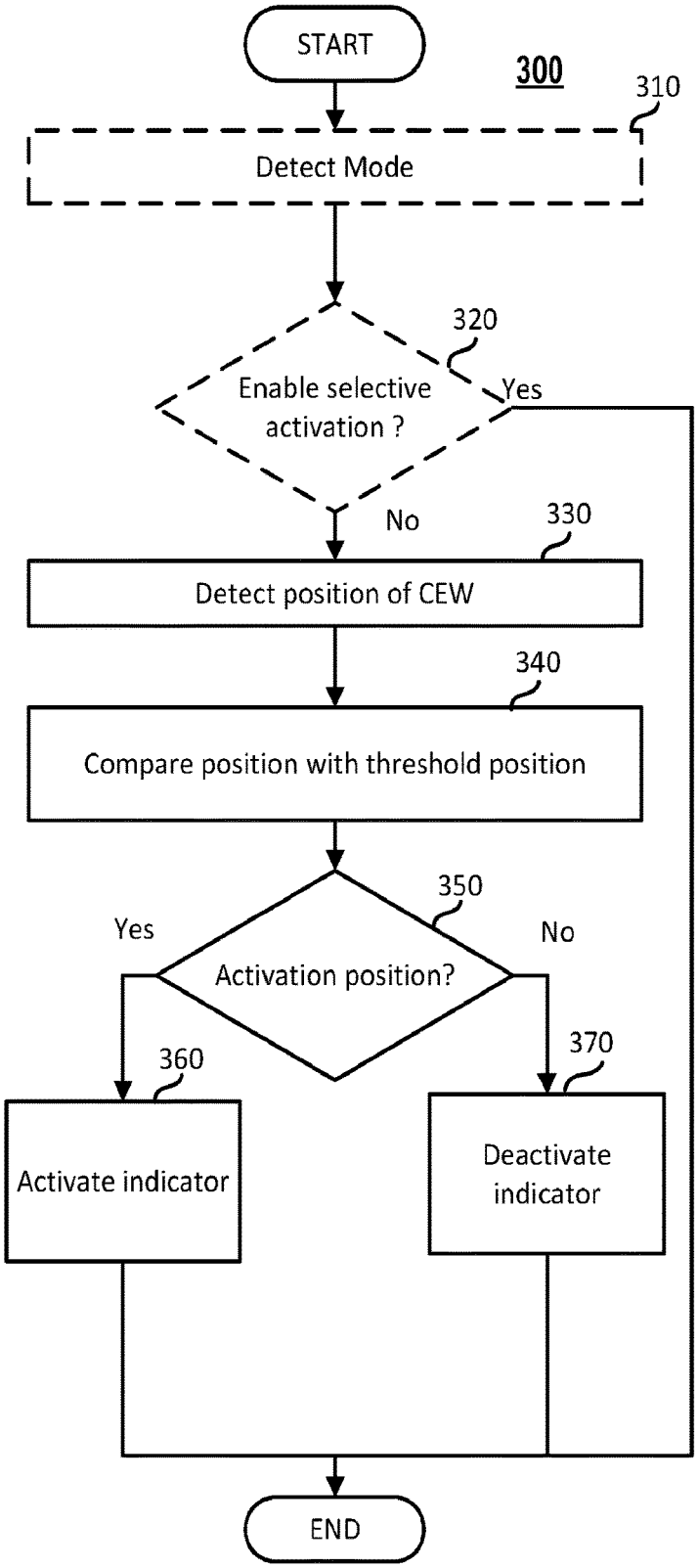
FIG. 3 illustrates a method performed by a conducted electrical weapon to selectively provide an indication from an indicator according to various aspects of the present disclosure.

In embodiments, one or more positions at which the indicator of the CEW may be deactivated (e.g., deactivation positions) may comprise at least one range of deactivation positions. The at least one range of deactivation positions may comprise two or more ranges of deactivation. A range of at least one range of deactivation positions may be greater than or less than an active range. For example, a range of deactivation positions may comprise one or more of a range of deactivation positions corresponding to second set of angles 250-2 or fifth set of angles 250-5. Alternately or additionally, the one or more ranges of positions may comprise ranges starting at a vertical position of the CEW. For example, a range of deactivation positions may comprise one or more of a range of deactivation positions corresponding to first set of angles 250-1 bound by first position 220-1 or sixth set of angles 250-6 bound by seventh position 220-7. Within the ranges of deactivation, an indicator of the CEW may be disposed in inactive state 230-2. The CEW may be configured to detect the position and responsive to the detected position comprising a deactivation position, dispose the indicator in active state 230-1 to cause an indication to be generated by the CEW. In embodiments, an indicator may be automatically provided in accordance with deactivating an indicator 370 with brief reference to FIG. 3, including as further discussed below.

In embodiments, a method of selectively providing an indication from an indicator may be provided. For example, and with reference to FIG. 3, method 300 may be performed by a conducted electrical weapon to activate an indicator according to various aspects of the present disclosure.

Method 300 may be performed by a CEW disclosed above with regards to FIG. 1-2. For example, processing circuit 110 of CEW 100 may perform one or more operations of method 300, including in accordance with a position detected by position detector. Processing circuit 110 of CEW 100 may perform one or more operations of method 300 to control an indication provided by one or more of audio output device 180 and indicator 190. In embodiments, a method of selectively activating an indicator may comprise detecting a mode 310 of a CEW, determining whether to enable selective activation 320, detecting a position of the CEW 330, comparing the position with a threshold position 340, determining whether the position comprises an activation position 350, activating an indicator 360, or deactivating the indicator 370. In embodiments, the indicator may comprise a laser indicator. In embodiments, an indicator may be automatically disabled in accordance with one or more operations comprising deactivating an indicator 370. In embodiments, method 300 may be performed in accordance with one or more positions 220, at least one range 240, or at least one set of angles 250 with brief reference to FIG. 2.

In embodiments, a method of selectively activating an indicator may comprise detecting a mode 310 of a CEW. The mode may be associated with use of the indicator. The mode may enable the indicator to be used for testing, training, or use of the CEW to deploy an electrode. For example, the mode may comprise a testing mode, training mode, or a safety OFF mode (e.g., armed) mode. The mode may be determined in accordance with an input received via a control interface. For example, safety switch 185 may be activated to cause CEW 100 to enter a safety OFF mode. In embodiments, detecting the mode 310 may comprise one or more of detecting an input from a control interface and/or accessing configuration information stored in a memory of a CEW.

In embodiments, and responsive to detecting a mode 310 of the CEW, determining whether to enable selective activation 320 may be performed. Enabling the selective activation may comprise comparing the mode to a set of predetermined modes. For example, a predetermined set of modes for enabling activation may comprise a testing mode, training mode, and a safety OFF mode. Enabling the selective activation may comprise comparing the detected mode to the set of predetermined modes to determine the detected mode matches at least one mode of the set of predetermined modes or the detected mode does not match the set of predetermined modes. The comparing (e.g., comparison performed in accordance with the determining 320) may indicate that the detected mode is associated with the selective activation being enabled or disabled. When the detected mode is associated with the selective activation being enabled, further operations of method 300 may be performed. When the detected mode is associated with the selective activation being disabled, method 300 may terminate. When selective activation is not enabled, the indicator may be automatically activated in accordance with the mode, automatically deactivated in accordance with the mode, or otherwise activated independent of the position of the CEW. In embodiments, operations 310 and/or 320 may be optional. One or more other operations of method 300 may be performed independent of a mode in embodiments according to various aspects of the present disclosure.

In embodiments, detecting a position 330 of the CEW may be performed. The position (e.g., position of the CEW) may comprise an angular position of the CEW. The position (e.g., position of the CEW) may comprise orientation of the CEW. The position may comprise a most recently detected position of the CEW. Detecting the position may be comprise receiving position information from a position sensor. For example, processing circuit 110 may detect a position of CEW 100 via position sensor 170. The position may comprise an orientation of CEW. The position may comprise a rotational position of the CEW about a horizontal axis. The position of the CEW may comprise a rotational position of the CEW within a vertical plane. The position of the CEW may correspond to a direction at which an electrode may be deployed from the CEW. The position may comprise an angle of orientation defined relative to a horizonal direction and/or horizonal axis. For example, the position may comprise an angle between negative ninety degrees and positive ninety degrees. Detecting the position 330 may comprise generating a detected position that identifies the position of the CEW. The detected position may be generated via a position sensor of the CEW. The detected position may be determined responsive to information received from a position sensor of the CEW.

In embodiments, detecting a position 330 of the CEW may comprise detecting a current position. The current position may be detected via a position detector of the conducted electrical weapon. For example, a gyroscope of the conducted electrical weapon may provide information regarding the position of the conducted electrical weapon and a processing circuit (e.g., position sensor 170 may provide position information to processing circuit 110 with brief reference to FIG. 1). The position may be detected by a processing circuit of the conducted electrical weapon via the position detector.

In embodiments, and in accordance with a position of the CEW, an indication from an indicator of the CEW may be automatically provided. Automatically providing the indication may comprise selectively activating an indicator. In accordance with the position of the CEW, the indicator of the CEW may be automatically activated to provide the indication. In accordance with the position of the CEW, the indicator of the CEW may be automatically deactivated to disable the indication. The position may comprise one or more of a current position or detected position of the CEW. The indicator may comprise a laser indicator. In embodiments, selectively activating the CEW in accordance with a position of the CEW may comprise one or more of comparing the position with a threshold position 340, determining whether the current position comprises an activation position 350, activating an indicator 360, or deactivating the indicator 370.

In embodiments, comparing the current position with a threshold position 340 may be performed. The comparing may be performed responsive to detecting the position 330. The threshold position may comprise one or more positions at which the CEW may be positioned. For example, the threshold position may include or be associated with one or more positions of positions 220 with brief reference to FIG. 2. In embodiments, the threshold position may comprise one or more of a maximum angle, a minimum angle, a range of positions, and/or an angle of orientation, as well as multiple and/or combinations of such positions or angles. For example, the threshold position may comprise range of positions 240. The threshold position may comprise a minimum angle and/or a maximum angle of range of positions 340. The threshold position may comprise a plurality of positions within range of positions 340. The plurality of positions may be equal to, or between, a maximum position and a minimum position of range of positions 340. Comparing the position 340 may comprise accessing information indicating the threshold position. For example, information regarding the threshold position may be received by processing circuit 110 to perform the comparing 340. The comparing may determine the position of the CEW is equal to the threshold position. Alternately or additionally, the comparing may determine the position of the CEW is within the threshold position. For example, the position may be determined to be equal to the threshold position or within a set of angles corresponding to the threshold position. For example, a fourth position 220-4 is within a threshold position comprising range 240 with brief reference to FIG. 2. In embodiments, a position that is equal to, or with a threshold position, may match or correspond to the threshold position.

In embodiments, and in accordance with comparing the position with the threshold position 340, determining a position of the CEW comprises an activation position 350 may be performed. The determining 350 may comprise detecting the position of the CEW comprises an activation position or a deactivation position. The position of the CEW may indicate (e.g., correspond to) an activation position or a deactivation position in accordance with the comparing 340. In embodiments, selectively activating the CEW in accordance with a position of the CEW may comprise detecting the position comprises an activation position or a deactivation position. When the position of the CEW matches, or corresponds to, a threshold position in accordance with the comparing 340 (e.g., a comparison performed relative to a position of the CEW and the threshold position), an activation position may be detected. When the position of the CEW does not match, or does not correspond to, the threshold position in accordance with the comparing 340, a deactivation activation position may be detected.

In some embodiments, one or more of operations 330, 340, and 350 may comprise a common operation. For example, position sensor 170 may be configured to generate a signal when the position of the CEW corresponds to an activation position. In such embodiments or similar embodiments, determining an activation position 350 may comprise detecting, via the sensor, the activation position. Alternately or additionally, determining the activation position 350 may comprise detecting 330 and/or comparing 340 as disclosed above with regards to FIG. 3.

In embodiments, and in accordance with an activation position of the CEW being determined, selectively activating an indicator may comprise activating the indicator 360. The indicator may comprise a laser indicator. For example, activating the indicator 360 may comprise disposing the indicator in an active state 230-1. Activating the indicator 360 may comprise generating an indication from the indicator. The indication may comprise one or more of an audible, a visible, and/or a haptic indication. The indication may comprise light emitted from a laser indicator. The indication may comprise a laser beam generated by the indicator in accordance with activation of the indicator. Activating the laser indicator may comprise emitting a visible indication in a direction in which an electrode may be concurrently deployed from the CEW. Responsive to activating the indicator 360, method 300 may end.

In embodiments, and in accordance with a deactivation position of the CEW being determined upon determining 350, selectively activating an indicator may comprise deactivating the indicator 370. The indicator may comprise a laser indicator. For example, deactivating the indicator 370 may comprise disposing the indicator in an inactive state 230-2. Deactivating the indicator 370 may comprise not generating an indication from the indicator. Deactivating the indicator 370 may comprise discontinuing an indication generated from the indicator. The indicator may comprise one or more of an audible, a visible, and/or a haptic indication. The indicator may comprise light emitted from a laser indicator. The indicator may comprise a laser beam generated by the indicator in accordance with activation of the indicator. In some embodiments, deactivating the laser indication may disable a visible indication that may otherwise emitted in a direction in which an electrode may be concurrently deployed from the CEW. In some embodiments, the electrode may still be deployed, though an indication may not be provided in accordance with deactivating the indicator 370. Responsive to deactivating the indicator 370, method 300 may end.

In embodiments, deactivating the indicator 370 may comprise logging the deactivation. For example, processing circuit 110 may comprise a non-transitory, computer-readable storage medium configured to store information. The information may include a log of activity performed by CEW 100. The log may comprise an audit log. The log may enable use of the CEW to be reviewed at later time, after an event involving use of the CEW, for reconstruction or review of the event. The audit log may enable the CEW to be debugged and errors in operation of the CEW to be identified. In embodiments, deactivating the indicator 370 may comprise storing information indicating the deactivation in the log. The information may include a timestamp indicating a time at which the deactivating was performed. The timestamp may be generated by processing circuit and/or clock integrated with the CEW. The log comprising the information for the activation (e.g., activation information) and/or the information for the deactivation (e.g., deactivation information) may be subsequently transmitted from the weapon to another computing device. For example, CEW 100 may comprise a wired or wireless communication interface by which the log may be transmitted from CEW 100 after activation 360 or deactivation 370.

In embodiments, activating an indicator 360 may alternately or additionally comprise logging information in the log. The information may identify the activation of the indicator. The information may be different from the information stored in accordance with deactivating the indicator 370. The information stored in the log may enable whether the indicator was placed in an active state or inactive state to be subsequently identified.

In embodiments, the indicator may be powered but caused to provide an indication (e.g., activated) or not caused to provide the indication (e.g., not activated) in accordance with one or more control signals. For example, processing circuit 110 may control indicator 190 to emit or not emit a light in accordance with an activation or deactivation selectively performed processing circuit 110 in accordance with a position of CEW 100.

In some embodiments, one or more operations method 300 may be performed periodically. For example, one or more of operations 330, 340, or 350 may be performed repeatedly after brief durations of time to rapidly activate or deactivate the indicator in accordance with the position of the CEW. The brief durations may comprise, for example, less than one second, less than 0.5 seconds, or less than 0.25 seconds. In embodiments one or more operations may be performed concurrently or after an operation of method 300. For example, after activating the indicator 360, an operation to deploy an electrode and/or deploy a next electrode may be performed.

The foregoing description discusses implementations (e.g., embodiments), which may be changed or modified without departing from the scope of the present disclosure. Examples listed in parentheses may be used in the alternative or in any practical combination. As used in the specification and illustrative embodiments, the words 'comprising,' 'comprises,' 'including,' 'includes,' 'having,' and 'has' introduce an open-ended statement of component structures and/or functions. In the specification and illustrative embodiments, the words 'a' and 'an' are used as indefinite articles meaning 'one or more'. In the illustrative embodiments, the term "provided" is used to definitively identify an object that not a claimed or required element but an object that performs the function of a workpiece. For example, in the illustrative embodiment "an apparatus for aiming a provided barrel, the apparatus comprising: a housing, the barrel positioned in the housing", the barrel is not a claimed or required element of the apparatus, but an object that cooperates with the "housing" of the "apparatus" by being positioned in the "housing."

The location indicators "herein," "hereunder," "above," "below," or other word that refer to a location, whether specific or general, in the specification shall be construed to refer to any location in the specification whether the location is before or after the location indicator.

Methods described herein are illustrative examples, and as such are not intended to require or imply that any particular process of any embodiment be performed in the order presented. Words such as "thereafter," "then," "next," etc. are not intended to limit the order of the processes, and these words are instead used to guide the reader through the description of the methods.

The scope of the disclosure is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. As used herein, numerical terms such as "first", "second", and "third" may refer to a given set of one or more elements, independent of any order associated with such set. For example, a "first" electrode may include a given electrode that may be deployed before or after a "second" electrode, absent further recited limitations of order.

What is claimed is:

1. A method performed by a conducted electrical weapon configured to deploy a projectile, the method comprising:

detecting a current position of the conducted electrical weapon; and in accordance with the current position, selectively activating an indicator of the conducted electrical weapon to provide an indication from the conducted electrical weapon, wherein selectively activating the indicator comprises:

comparing the current position to a predetermined range of rotational positions about a pitch axis, the predetermined range of rotational positions comprising a maximum angle of orientation;

activating the indicator when the comparing indicates the current position is less than or equal to the maximum angle of orientation and within the predetermined range of rotational positions; and deactivating the indicator when the comparing indicates the current position is greater than the maximum angle of orientation.

2. The method of claim 1, wherein detecting the current position comprises receiving position information from a position sensor of the conducted electrical weapon.

3. The method of claim 1, wherein the current position comprises an angular position.

4. The method of claim 1, wherein the predetermined range of rotational positions comprises a minimum angle of orientation determined in accordance with a direction of rotation of the conducted electrical weapon, wherein a first direction of rotation is associated with a first minimum angle of orientation and a second direction of rotation is associated with a second minimum angle of orientation different from the first minimum angle of orientation.

5. The method of claim 4, wherein the predetermined range of rotational positions comprises an angle equal to or less than seventy-five degrees.

6. The method of claim 1, wherein detecting the current position comprises detecting a mode of the conducted electrical weapon, and wherein the indicator is selectively activated in accordance with the mode.

7. The method of claim 6, wherein the mode comprises a safety OFF mode and the indicator is enabled to selectively activate in responsive to detecting the safety OFF mode.

8. A conducted electrical weapon comprising:

one or more electrodes;

an indicator configured to selectively provide a visible indication in a direction in which the one or more electrodes are configured to be deployed from the conducted electrical weapon;

a position sensor configured to detect a plurality of positions of the conducted electrical weapon; and a processing circuit coupled to the indicator and the position sensor, wherein the processing circuit is further configured to perform operations, comprising:

detecting, via the position sensor, a position of the plurality of positions; and in accordance with the position, automatically providing the visible indication from the indicator, wherein detecting the position comprises detecting a predetermined operating mode of the conducted electrical weapon, and automatically providing the visible indication comprises:

enabling selective activation of the indicator when the predetermined operating mode is detected; and disabling the selective activation when the predetermined operating mode is not detected.

9. The conducted electrical weapon of claim 8, wherein automatically providing the visible indication comprises activating the indicator.

10. The conducted electrical weapon of claim 8, wherein automatically providing the visible indication comprises providing the visible indication when the conducted electrical weapon is oriented less than thirty degrees above a horizontal direction.

11. The conducted electrical weapon of claim 8, wherein automatically providing the visible indication comprises providing the visible indication when the conducted electrical weapon is oriented less than thirty degrees below a horizontal direction.

12. The conducted electrical weapon of claim 8, wherein the indicator comprises a laser indicator.

13. The conducted electrical weapon of claim 8, wherein the predetermined operating mode comprises one mode of a predetermined set of modes, and the predetermined set of modes comprises a testing mode, a training mode, and a safety OFF mode.

14. A handle of a conducted electrical weapon configured to deploy a projectile, the handle comprising:

an indicator;

a position sensor configured to detect a plurality of positions of the conducted electrical weapon; and a processing circuit coupled to the indicator and the position sensor, wherein the processing circuit is further configured to perform operations, comprising:

detecting, via the position sensor, a position of the plurality of positions; and in accordance with the position, automatically providing an indication via the indicator; wherein:

the processing circuit further comprises a non-transitory, computer-readable storage medium configured to store information;

providing the indication comprises activating the indicator; and activating the indicator comprises logging information that identifies the activating of the indicator in a log stored in the computer-readable storage medium.

15. The handle of claim 14, wherein the operations further comprise transmitting the log comprising the information that identifies the activating of the indicator from the handle.

16. The handle of claim 14, wherein the indication is provided when the position of the handle comprises an angle of orientation of less than positive thirty degrees relative to a horizontal direction.

17. The handle of claim 16, wherein the indication is provided when the position of the handle comprises an angle of orientation greater than negative thirty degrees relative to the horizontal direction.

18. The handle of claim 16, wherein providing the indication comprises comparing the position to a minimum angle of a threshold position.

19. The handle of claim 18, wherein the minimum angle of the threshold position comprises a first angle of orientation when the handle is rotated in a first direction, the minimum angle of the threshold position comprises a second angle of orientation when the handle is rotated in a second direction opposite the first direction, and wherein the first angle of orientation is different from the second angle of orientation.

20. The handle of claim 14, wherein providing the indication comprises deactivating the indicator; and deactivating the indicator comprises logging second information that identifies the deactivating of the indicator in the log stored in the computer-readable storage medium.

* * * * *